US006431568B1

(12) United States Patent
McCleese

(10) Patent No.: US 6,431,568 B1
(45) Date of Patent: Aug. 13, 2002

(54) NARROW PROFILE TRUCK

(75) Inventor: Eddie S. McCleese, Costa Mesa, CA (US)

(73) Assignee: Macdaddy Skateboard Corp., Whittier, CA (US)

( * ) Notice: Subject to any disclaimer, the term of this patent is extended or adjusted under 35 U.S.C. 154(b) by 0 days.

(21) Appl. No.: 09/660,999

(22) Filed: Sep. 13, 2000

(51) Int. Cl.[7] ..... B62M 1/00

(52) U.S. Cl. ..... 280/87.042; 280/11.223; 280/11.28

(58) Field of Search ..... 280/87.042, 11.221, 280/11.223, 11.225, 11.27, 11.28

(56) References Cited

U.S. PATENT DOCUMENTS

| | | | | | |
|---|---|---|---|---|---|
| 301,676 | A | * | 7/1884 | Clark | 280/11.19 |
| 954,993 | A | | 4/1910 | Peters | |
| D150,401 | S | | 8/1948 | Brickson | |
| 2,540,847 | A | | 2/1951 | Thorson | |
| 3,086,787 | A | * | 4/1963 | Wyche | 280/11.19 |
| 4,062,557 | A | * | 12/1977 | Roden | 280/87.042 |
| 4,272,091 | A | * | 6/1981 | Reid, Jr. | 280/11.28 |
| 4,911,456 | A | * | 3/1990 | Sarazen | 280/11.204 |
| 5,224,718 | A | | 7/1993 | Gertler | |
| 5,419,570 | A | | 5/1995 | Bollotte | |
| 5,421,596 | A | | 6/1995 | Lee | |
| 5,492,352 | A | | 2/1996 | St. Clair | |
| 5,560,625 | A | | 10/1996 | Kuykendall | |
| 5,620,190 | A | | 4/1997 | Maggiore | |
| 5,660,401 | A | | 8/1997 | Yi | |
| 5,707,068 | A | | 1/1998 | Bradfield | |
| 5,984,328 | A | * | 11/1999 | Tipton | 280/87.042 |
| 6,042,123 | A | * | 3/2000 | Eck, Sr. | 280/11.19 |
| 6,158,753 | A | * | 12/2000 | Sturbaum | 280/87.042 |
| 6,193,249 | B1 | * | 2/2001 | Buscaglia | 280/87.042 |
| 6,209,894 | B1 | * | 4/2001 | Walker IV | 280/87.042 |

* cited by examiner

*Primary Examiner*—Robert P. Olszewski
*Assistant Examiner*—James S. McClellan
(74) *Attorney, Agent, or Firm*—James G. O'Neill

(57) ABSTRACT

A platform having improved performance characteristics and stability includes at least one truck resiliently secured thereto. The at least one truck includes a body having an in-line skate chassis attached to a two-wheel truck. The two-wheel truck is formed by passing an axle through at least one of a plurality of wheel openings in the in-line skate chassis. The entire assembly is secured to the bottom of the platform by a suspension system having a turning horn operatively connected therein to allow the platform to pivot and move in a vertical direction, with respect to the at least one truck. The two-wheel truck may include tubular axle holding portions secured thereto.

14 Claims, 6 Drawing Sheets

NARROW PROFILE TRUCK

BACKGROUND OF THE INVENTION

1. Field of the Invention

This invention relates generally to wheeled structures, and more particularly, to improved narrow profile trucks for use on skateboards, roller skates, and the like.

2. Description of Related Art

In recent years, the popularity of wheeled structures, such as in-line skates, skateboards and the like have increased dramatically. This has been due, in large part, to technological innovations, which have improved the ride and handling of skates, skateboards, and the like, and because of the large number of individuals utilizing different criteria for smoother, safer and faster rides.

With this expansion in popularity of such devices, skateboards, for example, have changed dramatically, such as in their size and shape.

In their most common current forms, in-line skates usually have one truck with a number of polyurethane wheels, while skateboards usually have front and back trucks with two polyurethane wheels in each. The skateboard trucks are mounted on the bottom side of a flexible or rigid board with one set of the wheels attached to the front end of the board, and the other set of wheels being attached to the rear end of the board by their respective trucks. In both in-line skates and skateboard, wheels or each set of wheels is typically mounted on an axle in the truck assembly, and the truck assembly mounts to a connection with the skate or skateboard. This connection allows a user to displace the axle from its usual orientation to the axis of the skate or skateboard. The axles of the front and rear sets of wheels in skateboards are displaced by the user tilting the board so that the axles each come to lie on a radius of a circle, thereby orienting the wheels so that they steer the skateboard in a desired direction. The arrangement of trucks and wheels in skates and skateboards provides favorable cornering characteristics along with some stability, enabling skilled skaters and skateboarders to negotiate smooth, sharp turns in rapid succession. However, as the shape and sizes of skates and skateboards change, and the uses thereof widen, for example, luge, or high-speed downhill skateboarding, a need exists for different types of trucks and different configurations of wheels thereon for attachment to any type of board, platform, skate, or the like.

A variety of skateboard designs having in-line wheel configurations have been adopted. Examples of such skateboards are set forth in U.S. Pat. No. 5,419,570 to Bollotte, U.S. Pat. No. 5,492,352 to St. Clair, U.S. Pat. No. 5,560,625 to Kuykendall, U.S. Pat. No. 5,660,401 to Yi and U.S. Pat. No. 5,707,068 to Bradfield. The in-line arrangement of each of these patents differ, with the U.S. Pat. No. 5,419,570 patent having a single alignment of six singular wheels. This skateboard also has a handle, such as used on a scooter.

The U.S. Pat. No. 5,492,352 patent shows a roller board having front and back sets of six wheels each, in pairs of two, with the wheels being sequentially aligned and parallel to a longitudinal axis of the board.

The U.S. Pat. No. 5,560,625 patent discloses a modified truck assembly for attachment to a board surface, in which the truck has two pair of extended ridges to act as skidding pads, and a channel in the bottom which holds an aligned set of in-line wheels.

The U.S. Pat. No. 5,660,401 patent discloses a single line of in-line wheels and a rear roller of relatively larger diameter than the aligned in-line wheels.

The U.S. Pat. No. 5,707,068 patent has a plurality of in-line wheels rotatably mounted on the front end of the board, and rear wheels disposed at either side of the rear end of the board, with the board having a resiliently flexible portion between the in-line front wheels and the rear wheels.

Each of these in-line skateboards provide improved results for a specific need or performance, but are not adaptable to all situations, and are not useful in high-speed situations. Therefore, there exists a need in the art for an improved in-line skateboard having narrow profile wheel trucks that extend the life of the wheels used and increases the performance of a skateboard, especially at high speeds.

Many types of in-line roller skates are known, for example, see U.S. Pat. No. 954,993 to J. W. Peters (deceased), U.S. Pat. No. 2,540,847 to Thorson, U.S. Pat. No. 5,224,718 to Gertler, U.S. Pat. No. 5,421,596 to Lee and, U.S. Pat. No. 5,620,190 to Maggiore. These patents all show or disclose various in-line skate systems having a plurality of rollers therein, including outrigger rollers for stabilization of a skater's feet. However, these patents fail to show or disclose how such in-line skate elements may be applied or used on a skateboard, and are not easily adaptable for a skateboard, without significant changes and/or redesigning thereof. Furthermore, the trucks of such known skates do not fulfill the requirements of the narrow profile trucks of the present invention.

SUMMARY OF THE INVENTION

Accordingly, it is a general object of the present invention to provide improved and simplified narrow profile trucks. These trucks may be used on skates, skateboards or any other platform-type of device that a person can lay, sit, stand, or be pulled on. There are many reasons why there is a need for such narrow profile trucks, for example, when used on skates or skateboards, such trucks include the following:

a) the extended support of the truck formation of the present invention greatly reduces slip-and-fall accidents;

b) the trucks of the present invention provide high-performance in racing;

c) the trucks of the present invention provide improved stability and reduces speed wobble;

d) the trucks of the present invention glide over cracks, rough surfaces, as well as rocks and other road hazards with which traditional trucks have trouble;

e) the trucks of the present invention provide an extremely smooth ride because the wheels thereof share in the shock of the road;

f) the novel chassis design of the improved trucks of the present invention allow the wheels and axles thereof to be alternately placed inside or outside of side plates;

g) the unique design of the trucks of the present invention allow an in-line chassis to be used, which chassis freely floats on the bottom of a pair of skates or a skateboard by a suspension system secured to the bottom surface of the skates or skateboard for extreme and vastly improved maneuverability;

h) the improved chassis of the trucks of the present invention allows the trucks to be cast in one solid piece, or in multiple pieces;

i) the improved truck and chassis combination of the present invention is adaptable to most of the currently manufactured skates and skateboards and accessories therefor;

j) the unique, unencumbered exterior chassis walls of the improved trucks of the present invention provide a surface to which commercial logos or designs may be applied;

k) the improved trucks of the present invention allow the use of different size wheels, as well as different size in-line wheels;

l) the improved overall performance and appearance of the trucks of the present invention provide a streamlined design for all size skates or skateboards, as well as increasing the performance, safety and compatibility thereof with existing skates, skateboards and in-line products.

It is a particular object of the present invention to provide a narrow profile truck, which accommodates narrow profile wheels, such as in-line roller skate wheels or traditional skateboard wheels.

These and other objects and advantages of the present invention are achieved by providing a platform with improved trucks on at least one portion thereof. The trucks include a two-wheel portion having an in-line skate chassis attached or secured thereto and inserted in one or more wheel openings formed in the chassis. The in-line chassis of the truck of the present invention is secured to the bottom of the platform by means of a unique suspension system having a turning horn operatively connected therein.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

Figure 2:
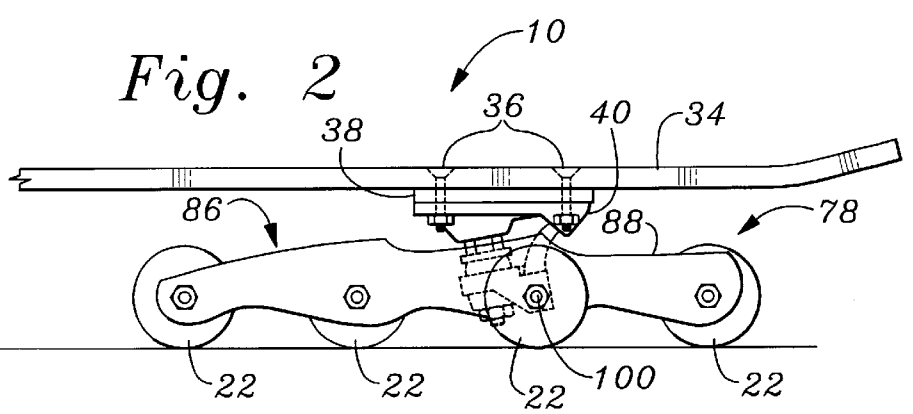
FIG. 2 is a partial side elevational view of a further embodiment of a truck of the present invention, attached to a partial platform or surface, such as a skateboard.
Figure 1:
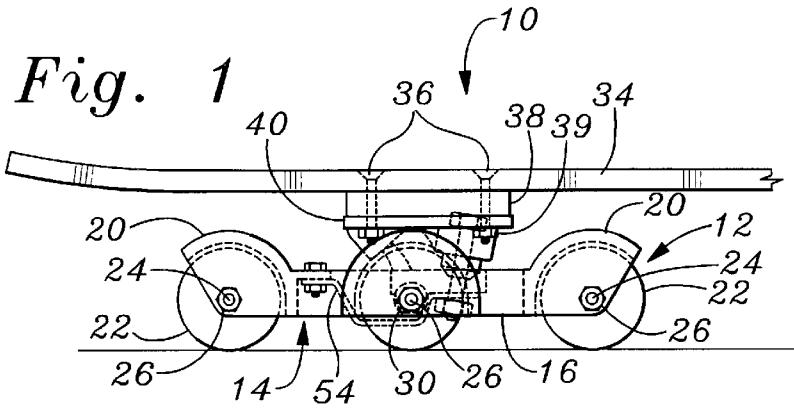
FIG. 1 is a partial side elevational view of a preferred embodiment of a truck of the present invention, attached to a partial platform or surface, such as a skateboard.
Figure 4:
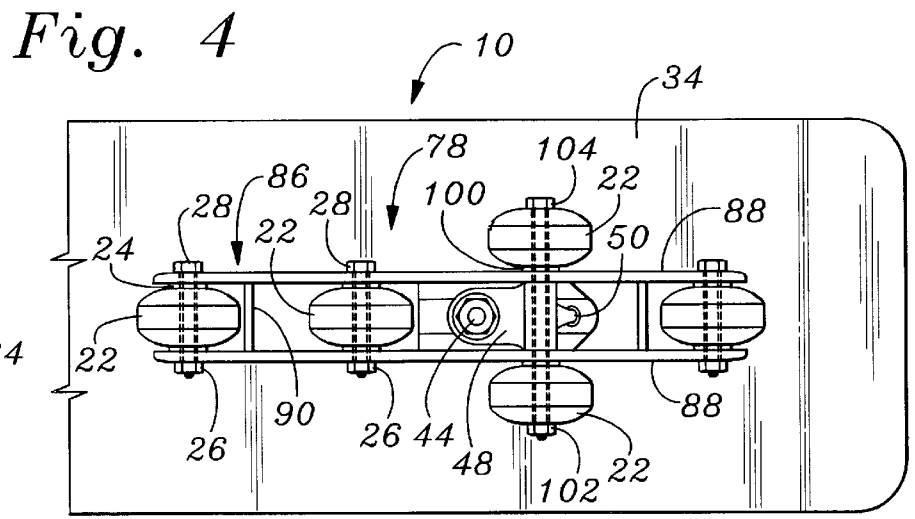
FIG. 4 is a bottom plan view of the truck of FIG. 2.
Figure 3:
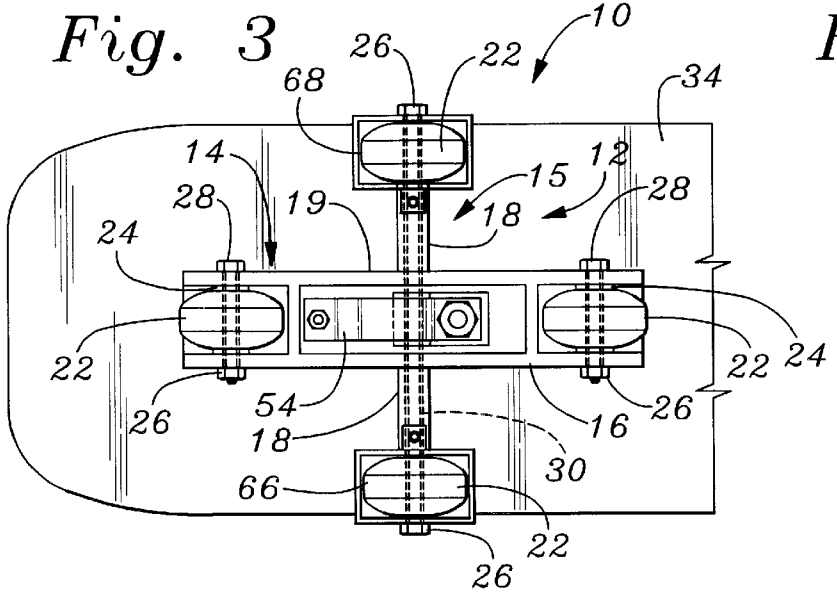
FIG. 3 is a bottom plan view of the truck of FIG. 1.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved and simplified modified truck system for a platform, such as a roller skate, a skateboard, or the like. For reasons of explanation only, and not by way of limitation, the truck system will be described in connection with a flat platform, such as a skateboard, generally indicated at 10.

Turning now to the drawings, as shown in FIGS. 1, 3 and 5–8, a first preferred embodiment of the modified truck assembly of the present invention is shown at 12. This first truck assembly 12 includes an integral or unitary body 14, including an in-line wheel section 16, which may be elongated, and a truck section 15, having tubular axle holding elements or portions 18, held, or integrally formed on either side of the in-line wheel section 16. The in-line wheel section 16 includes a central portion 19 and at least one, but preferably two end portions 20 having fenders formed thereon. At least one wheel 22 is rotatably mounted at either the front or rear ends in a fender, by means of an axle 24 held by or formed by securing means, such as nuts 26 and/or a bolt head 28. If the axle 24 is threaded at both ends, the nuts 26 are attached thereto. The truck section 15 has the holding portions 18 secured to or formed integrally with the central portion 19 of the in-line section 16, and includes a further elongated axle 30 extending therethrough and having at least two wheels 22 rotatably mounted thereon. Further wheels 22 may be added on either end of the axle 30, if desired. Each of the wheels 22 may be exactly the same as, or different than the at least one wheel 22 in the in-line wheel section 16. The axle 30 is held in position by securing means, such as a plurality of nuts 26, secured to threaded ends 32 (see FIG. 7). Spacers will be added to axle 30, between adjacent wheels 22, if more than one wheel is mounted on opposite ends of the holding portions 18 and axle 30.

Figure 5:
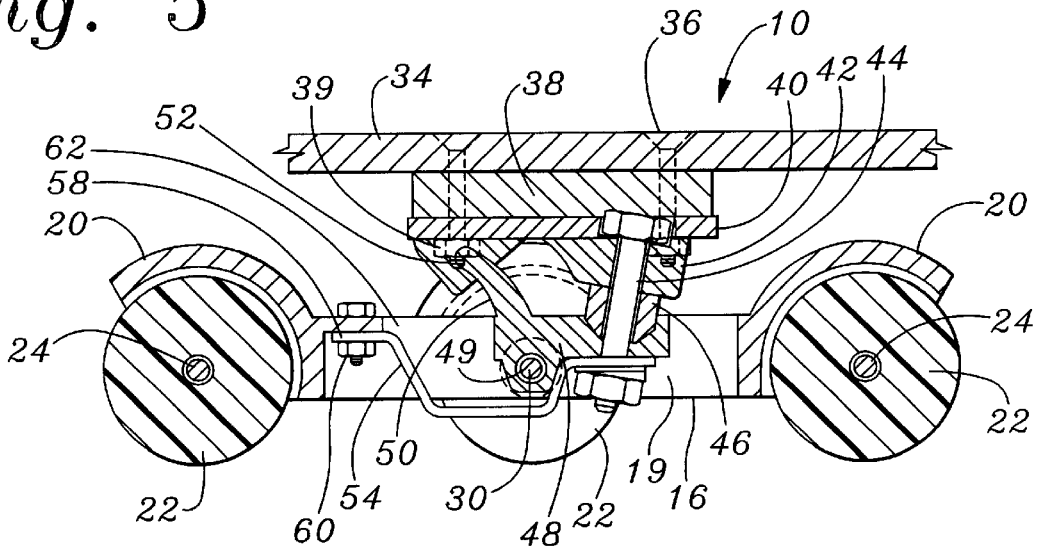
FIG. 5 is an enlarged partial sectional view of the truck and partial platform of FIG. 1.
Figure 6:
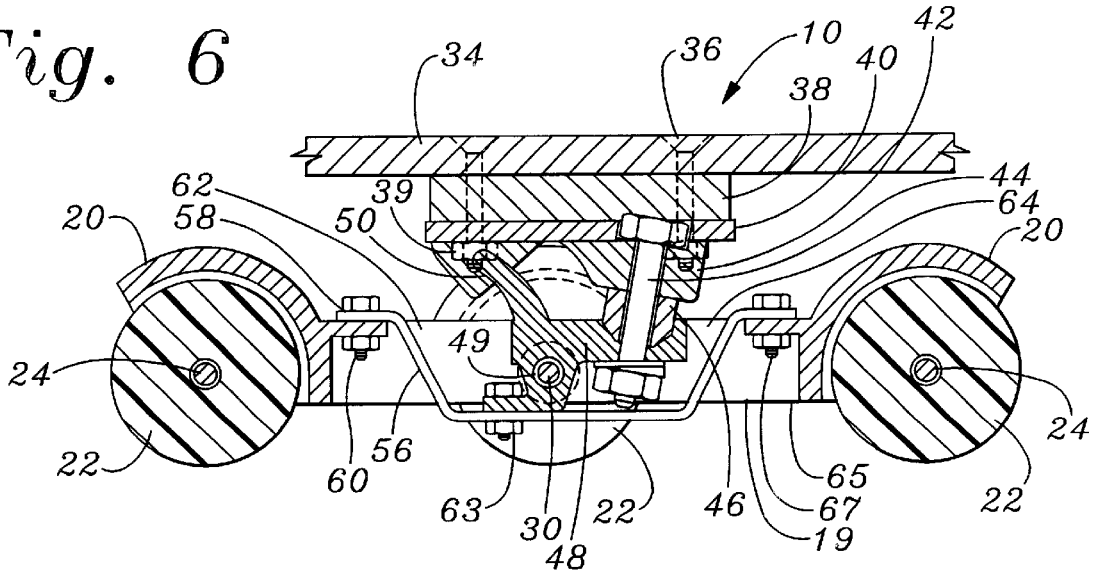
FIG. 6 is an enlarged partial sectional view of a further embodiment of the truck and partial platform, similar to the truck of FIG. 1, but having a further spring mounting element therein.
Figure 7:
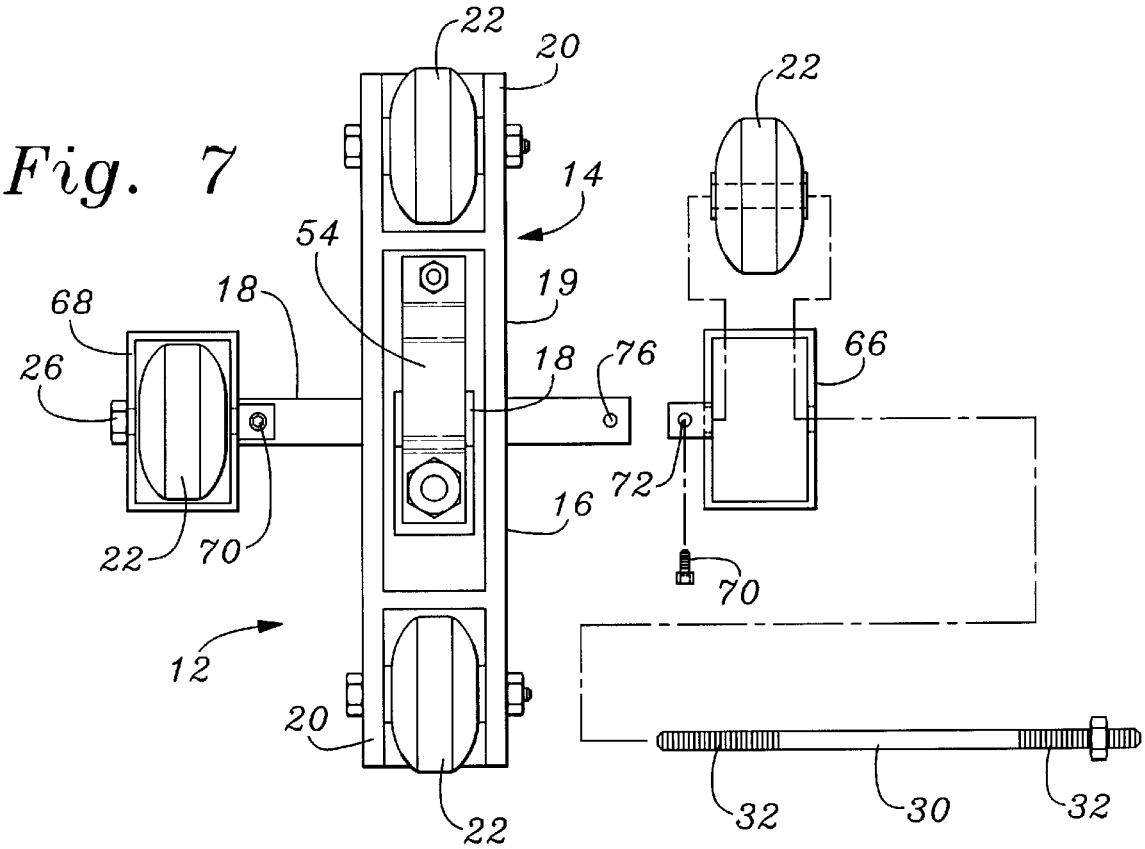
FIG. 7 is an exploded bottom plan view of the truck of FIG. 1.
Figure 8:
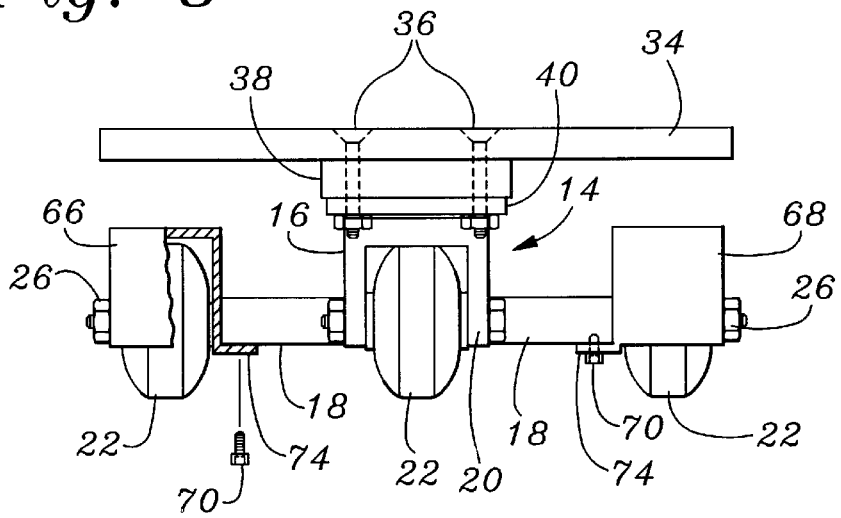
FIG. 8 is a rear elevational view, with a portion broken away, of the truck of FIG. 1.
Figure 9:
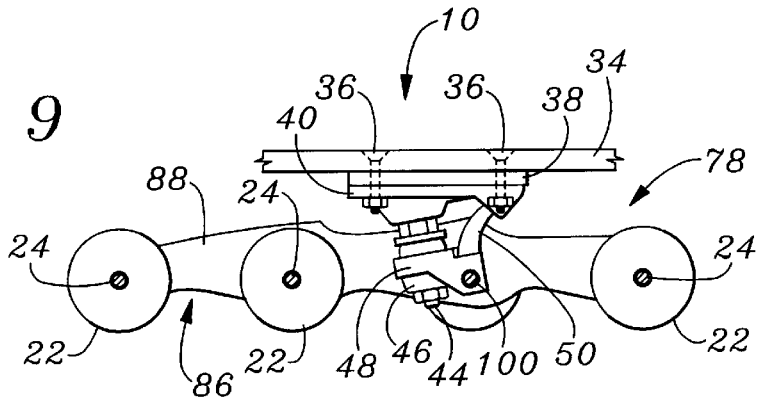
FIG. 9 is a partial cross sectional view of the truck and partial platform of FIG. 2.
Figure 10:
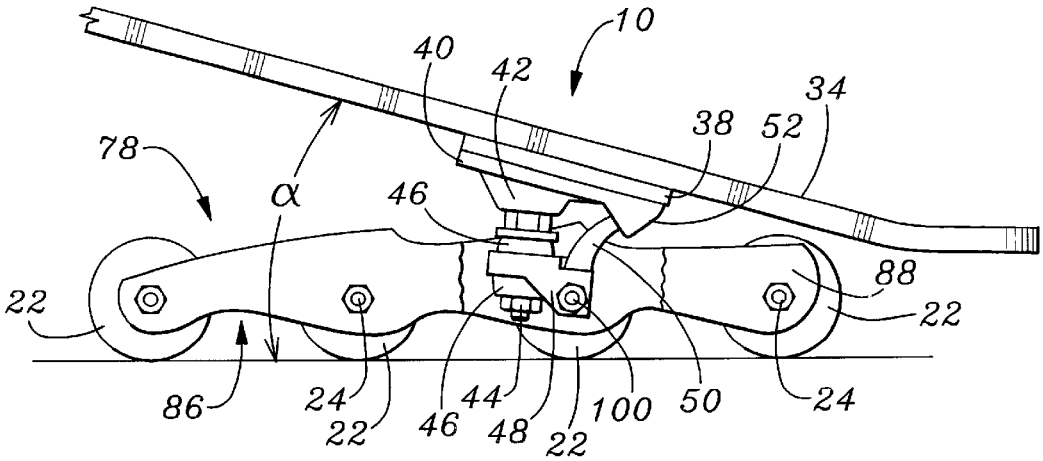
FIG. 10 is an enlarged side elevational view of the truck and partial platform of FIG. 2, partly broken away, with the partial platform raised vertically with respect to the truck.

The modified truck 12 of the present invention is preferably resiliently mounted to the bottom of a board or surface 34, as by means of a plurality of securing elements 36 passing through the board and a spacer block 38, and secured to an upper plate 40, by holding elements, such as nuts 39. As best shown in FIGS. 5 and 6, the upper plate 40 has a first downwardly depending portion 42 having a means for securing 44, such as an elongated nut and bolt, passing through the portion 42 and at least one resilient spacer 46 held on the securing means 44, adjacent an axle holding portion 48. The axle holding portion 48 has the axle 30 passing through an opening 49 formed therein, and includes a horn 50 held in an opening in a second lower portion 52 of upper plate 40. This mounting system, allows the entire truck assembly 12 to be resiliently mounted on the board 34 to allow controlled pivoting thereof, and to provide increased performance, together with improved stability and a reduction of speed wobble. The axles 24 and 30 may be mounted so as to be capable of spinning live, or may be press-fit into the axle holding opening so as to have no spin.

The stiffness of the pivotable movement of the in-line skate portion of the truck assembly 12 may be modified or adjusted by providing means for stiffening 54, 56, such as a leaf spring made from spring steel, or the like. As shown in FIG. 5, the stiffener 54 has one end secured to the securing element 44 and a second end 58 secured to the in-line wheel section 16 by a securing element 60. If desired, the second end 58 of leaf spring 54 may pass through an opening 62 formed in body 14 and pass over the fender 20 on the first end of the body 14. As shown in FIG. 5, the leaf spring 54 may also be secured to the securing element 44, or at the bottom of the body 14, by securing element 44. Or, as shown in FIG. 6, the leaf spring 56 may be secured to the axle holding portion 48 by a further securing element 63. A second end 65 of the leaf spring 56 then passes through a second opening 64 in the body 14 where it may be secured by a further securing element 67, or it may be extended so as to pass over and be secured to the fender 20 at the second end of the body 14. The leaf springs 54, 56 will limit vertical movement of the truck 12, with respect to the board 34, to control or limit vertical movement of the truck.

Figure 11:
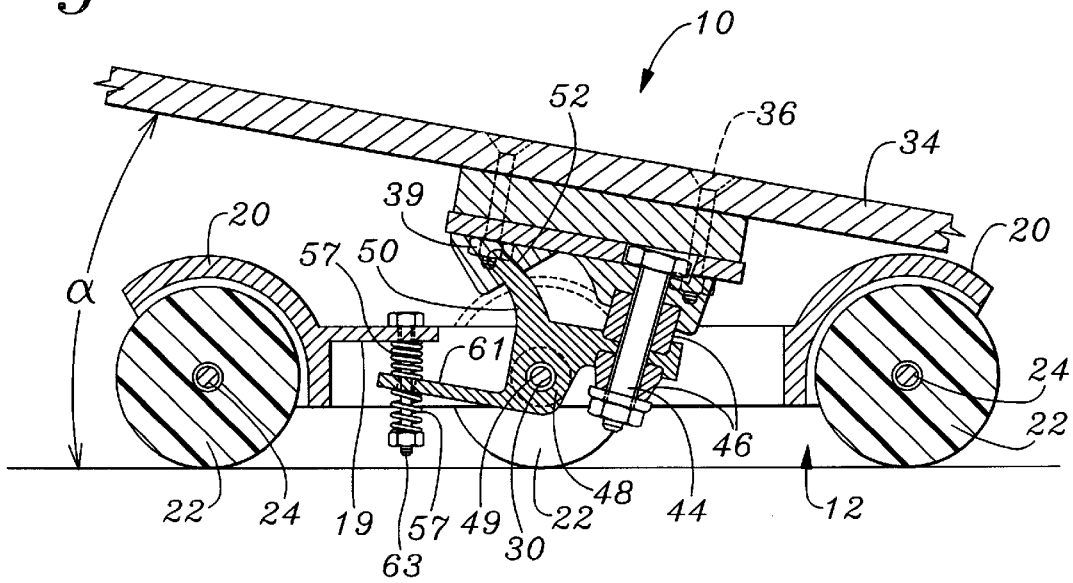
FIG. 11 is an enlarged partial, cross-sectional view of a further embodiment of a truck and partial platform with further springs in a suspension system, and the partial platform raised vertically with respect to the truck.

As shown in the further embodiment of FIG. 11, the leaf springs 54, 56 may be replaced by coil springs 57, held around an elongated securing element 63, held in an opening formed on an extension 61 of the central axle holding portion 48. The securing element 63 also passes through an opening in the central portion 19 of the in-line chassis or section 16, and, depending on the tightness thereof, will compress or release the coil springs 57 to control or limit vertical movement of the truck 12 to allow the board 34 to pivot or move a substantial amount in the vertical direction, as shown by the angle alpha.

As best shown in FIGS. 1, 3, 7 and 8, the one or more outer wheels 22 at the ends of the tubular elements 18 on axle 30 may be provided with fenders 66, 68 to prevent the bottom of the board 34 from hitting the outer wheels 22 when the board is tilted by a user. These fenders 66, 68 may be removed or added over the one or more wheels 22 at the ends of the tubular elements 18 by means of securing elements or screws 70 passing through openings 72 in tabs 74 of the fenders, and secured in openings 76 on the underside of the ends of the tubular elements 18.

Turning now to FIGS. 2, 4, 9 and 10, there shown is a still further embodiment of a modified truck and chassis assembly 78. This truck chassis assembly 78 may be used at either the front or rear of the skateboard 34, or two trucks chassis assemblies 78 may be used on a single skateboard. The second truck chassis assembly 78 is secured to the board 34 by means of bolts 36, the resilient spacer block 38, the upper plate 40 with first and second lower portions 42, 52, the securing element 44, and first and second resilient spacers 46. These elements are also connected to an axle holding portion 48, having the horn 50 thereon. The horn 50 also cooperates with the opening in the second lower portion 52 of the upper plate 40. The second resilient spacer element 46 is shown mounted on the securing element 44 to allow the truck chassis assembly 78 to be resiliently coupled to the board 34 so as to allow it to pivot, as well as to move a substantial amount in a vertical direction, as shown by the angle alpha in FIG. 10. The second truck chassis assembly 78 includes an elongated in-line section 86 having spaced-apart side plates 88. The side plates 88 may be separate elements or may be secured together by bridging means, such as 90, (FIG. 4), and may take any desired shape or may be of any desired length, such as shown at 92, 94, 96, 98 in FIGS. 13–16. Each of the side plates 88, 92, 94, 96, 98 will include a plurality of aligned openings to enable a plurality of axles 24 to be inserted therethrough and secured in place by securing elements, such as nuts 26 and/or bolt heads 28, so as to hold a plurality of aligned wheels 22 therein. As shown in FIGS. 2, 4, 9 and 10, three aligned wheels are used. However, if plates 92–98 were used, further wheels and axles could be added thereto so as to extend the length of the aligned skate portion, and/or further truck sections, as described below, could be used.

As shown in FIGS. 2, 4, 9 and 10, at least one elongated axle 100 passes through the opening 49 in the axle-holding portion 48, or through other of the aligned openings. This axle 100 includes at least one wheel 22 on both ends thereof, outside of the side plates 88. The wheels 22 and axle 100 are held in place by means of a plurality of holding elements, such as nuts 102 secured on threaded ends, or a nut 102 and a bolt head 104.

FIG. 11 illustrates the truck assembly 12 secured to a board or platform 34, as described above. The board 34 is resiliently coupled to the truck assembly 12 so as to allow the board to pivot, as well as to move a substantial amount in the vertical direction.

Figure 12:
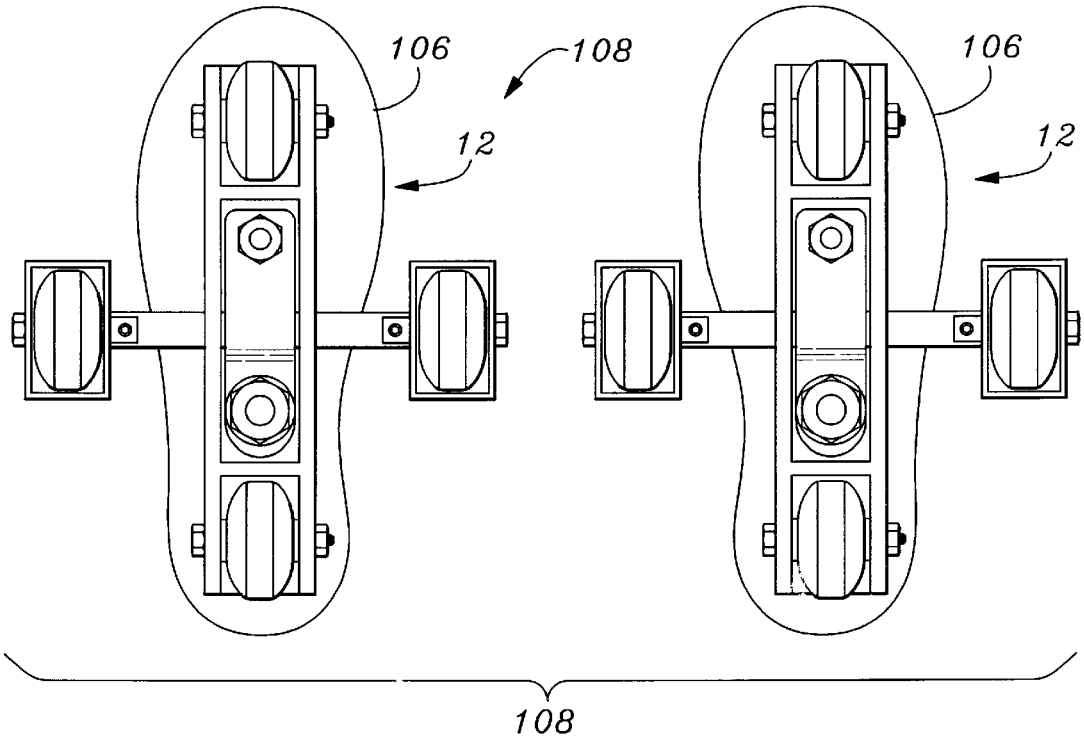
FIG. 12 shows a further embodiment of a truck of the present invention, mounted on a pair of shoes to form skates.
Figure 13:
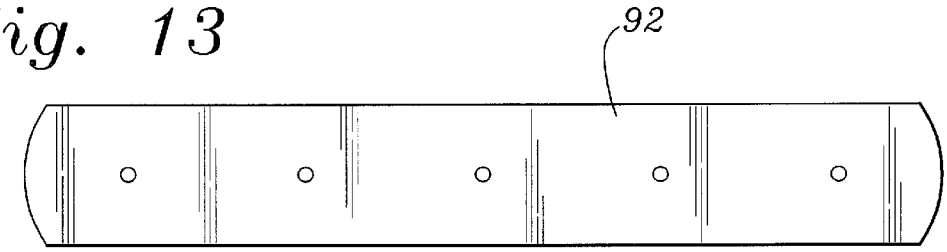
FIGS. 13–16 are further embodiments of side plates that may be utilized with the in-line chassis portion of the trucks of the present invention.
Figure 14:
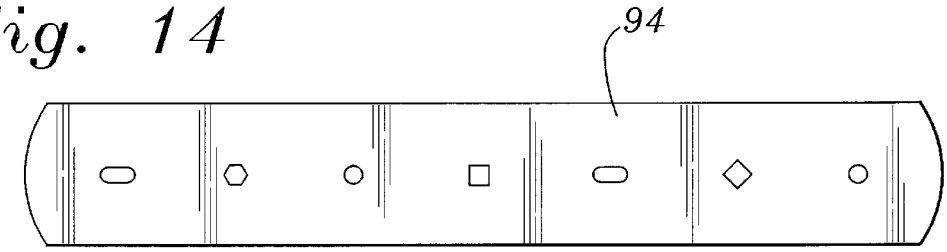
Figure 15:
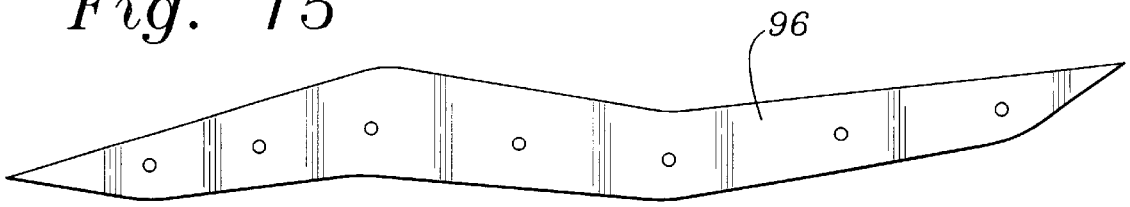
Figure 16:
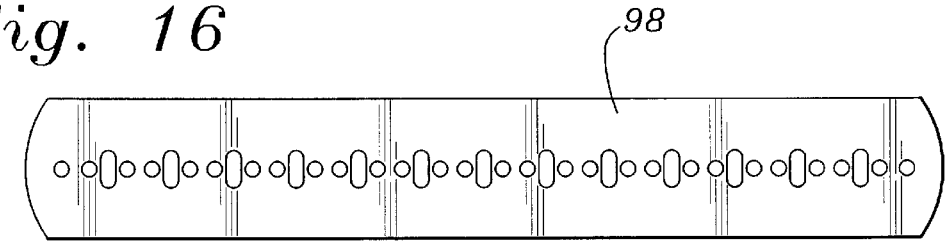

FIG. 12 shows truck assemblies 12 secured to the bottom of boots, or the like 106, to form a pair of roller skates 108.

It, therefore, can be seen that the present invention provides an improved and versatile truck assembly having at least one, but preferably a plurality of in-line wheels, and at least one pair of outer wheels. This improved truck assembly may be secured to any platform, such as a pair of skates, or a skateboard, to increase the speed and performance of the platform, while at the same time providing increased stability and ride comfort.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. An improved truck assembly for a platform comprising:

an elongated body having a plurality of openings therein;

a plurality of wheels held in-line and rotatably mounted in some of the plurality of openings in the elongated body;

the elongated body including a pair of extending, hollow axle holding portions, connected to one of the plurality of openings; an axle passing through the one of the plurality of openings and the pair of extending hollow axle holding portions and holding at least one pair of wheels at opposed outer ends of the pair of extending, hollow axle holding portions; and resilient means for mounting the elongated body to a bottom side of the platform.

2. The improved truck assembly of claim 1 wherein the resilient means for mounting the truck to the bottom side of the platform includes a plurality of securing elements passing through the platform and a spacer block and is secured to an upper plate having a pair of downwardly depending portions; a first of the downwardly depending portions having a horn secured to an axle holding portion, held therein; whereby the truck may be moved with respect to the platform.

3. The improved truck assembly of claim 2, further including a securing element held in a second of the downwardly depending portions and connected to an axle holding portion; and the axle holding portion being resiliently mounted in the elongated body.

4. The improved truck assembly of claim 3 wherein the horn is secured to the axle holding portion.

5. The improved truck assembly of claim 1, further including a securing means held in a first of a pair of downwardly depending portions and connected to an axle holding portion; and the axle holding portion is resiliently mounted in the elongated body.

6. The improved truck assembly of claim 5 wherein the horn is secured to the axle holding portion.

7. An improved truck assembly for a skateboard comprising:

an elongated body having a plurality of openings therein; one of the plurality of openings being aligned with a pair of tubular axle holding portions;

at least one wheel held in and rotatably mounted in a second of the plurality of openings in the elongated body;

at least one pair of wheels, mounted on outer ends of an axle passing through the one of the plurality of openings and the aligned tubular holding portions; and resilient means for mounting the elongated body to a bottom side of the skateboard.

8. The improved truck assembly of claim 7 wherein there are a plurality of wheels held in-line and rotatably mounted in some of the plurality of openings in the elongated body.

9. The improved truck assembly of claim 8 wherein the resilient means for mounting the truck to the bottom side of the skateboard includes a plurality of securing elements passing through the skateboard and a spacer block and is secured to an upper plate having a pair of downwardly depending portions; a first of the downwardly depending portions having a horn secured to an axle holding portion, held therein; whereby the truck may be moved with respect to the skateboard.

10. The improved truck assembly of claim 9, further including a securing means held in a second of the downwardly depending portions and connected to an axle holding portion; and the axle holding portion is resiliently mounted in the elongated body.

11. The improved truck assembly of claim 10, further including at least one spring secured between the axle holding portion and the elongated body.

12. An improved truck assembly for a platform comprising:

an elongated body having a plurality of openings therein;

at least one wheel held in and rotatably mounted in one of the plurality of openings in the elongated body;

at least one pair of wheels, mounted on outer ends of an axle passing through a second of the plurality of openings and an aligned pair of tubular axle holding portions; and resilient means for mounting the elongated body to a bottom side of the platform; the resilient means for mounting the truck to the bottom side of the platform including a plurality of securing elements passing through the platform and a spacer block and secured to an upper plate having a pair of downwardly depending portions; a first of the downwardly depending portions having a horn secured to an axle holding portion, held therein; whereby the truck assembly may be moved with respect to the platform.

13. The improved truck assembly of claim 12, further including a securing means held in a second of the downwardly depending portions and connected to an axle holding portion; and the axle holding portion is resiliently mounted in the elongated body.

14. The improved truck assembly of claim 13 wherein the horn is secured to the axle holding portion.

* * * * *

UNITED STATES PATENT AND TRADEMARK OFFICE

CERTIFICATE OF CORRECTION

PATENT NO. : 6,431,568 B1 
DATED : August 13, 2002
INVENTOR(S) : Eddie S. McLeese It is certified that error appears in the above-identified patent and that said Letters Patent is hereby corrected as shown below:

Title page,
Item [12], "McCleese" should read -- McLeese --
Item [75], Inventor should read as follows: -- Eddie S. McLeese --.

Signed and Sealed this

Twenty-second Day of July, 2003

JAMES E. ROGAN
*Director of the United States Patent and Trademark Office*